US007052206B1

(12) United States Patent
Mastromonaco

(10) Patent No.: US 7,052,206 B1
(45) Date of Patent: May 30, 2006

(54) SYSTEM AND METHOD FOR USE OF AN EXTENTION BASIN AS A STORM WATER CONTROL DEVICE

(76) Inventor: Ralph G. Mastromonaco, 11 Apple Hill Dr., Cortlandt Manor, NY (US) 10567

( * ) Notice: Subject to any disclaimer, the term of this patent is extended or adjusted under 35 U.S.C. 154(b) by 0 days.

(21) Appl. No.: 10/833,759

(22) Filed: Apr. 28, 2004

Related U.S. Application Data

(60) Provisional application No. 60/466,929, filed on Apr. 30, 2003.

(51) Int. Cl.
*E02B 11/00* (2006.01)
*E02B 1/00* (2006.01)

(52) U.S. Cl. ..... 405/39; 405/53; 405/80

(58) Field of Classification Search ..... 405/36, 405/39, 52, 53, 80, 87, 92, 107; 210/170
See application file for complete search history.

(56) References Cited

U.S. PATENT DOCUMENTS 3,837,168 A * 9/1974 Alsberg et al. ..... 405/50
4,457,646 A * 7/1984 Laesch ..... 405/52
5,161,911 A * 11/1992 Regan ..... 405/37
5,232,307 A * 8/1993 Nouri ..... 405/36
5,342,144 A * 8/1994 McCarthy ..... 405/39
6,102,618 A * 8/2000 Takada et al. ..... 405/52
6,350,374 B1 * 2/2002 Stever et al. ..... 210/170
6,638,424 B1 * 10/2003 Stever et al. ..... 210/170
2001/0013489 A1 * 8/2001 Williamson ..... 210/153
2003/0106859 A1 * 6/2003 Miyata et al. ..... 210/793

* cited by examiner

*Primary Examiner*—John Kreck
(74) *Attorney, Agent, or Firm*—Milde & Hoffberg LLP

(57) ABSTRACT

This paper proposes an integrated approach to storm water management and storm water treatment. Today's requirements for capturing and treating the first-flush of storm water can be met with a new device that also controls peak flows over a wide range of storms and uses a net storage volume that is substantially lower than the storage computed by traditional reservoir routing methods.

The extention basin debuts here as the most efficient method of reducing peak storm water flows—being far more effective than the retention or detention basins in common use today.

38 Claims, 7 Drawing Sheets

Figure 1: Typical Reservoir Routing Inflow / Outflow Hydrographs (flow versus time)
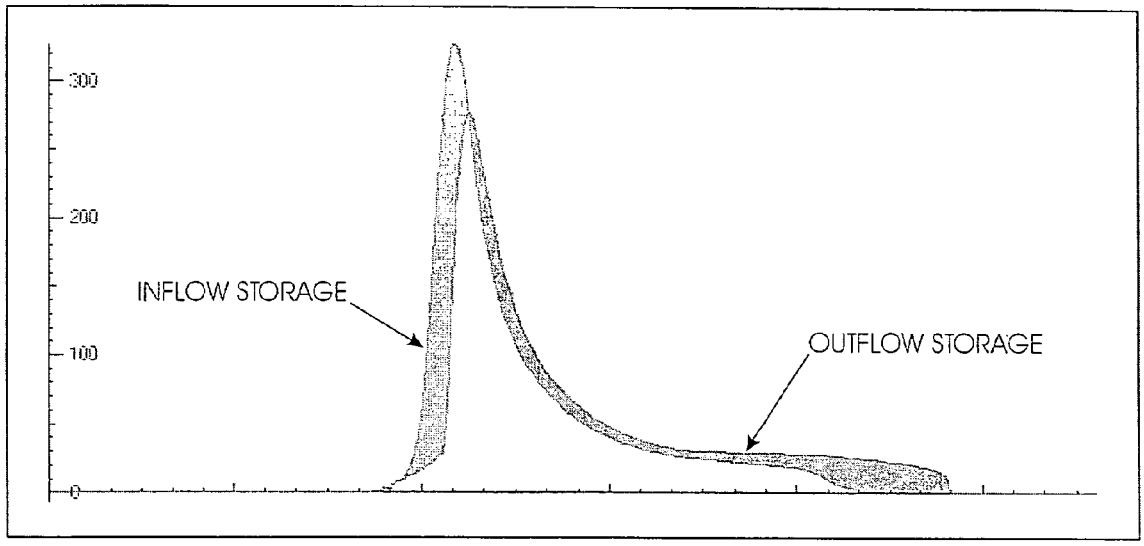
Figure 2: Typical Storage Basin System Flow Path
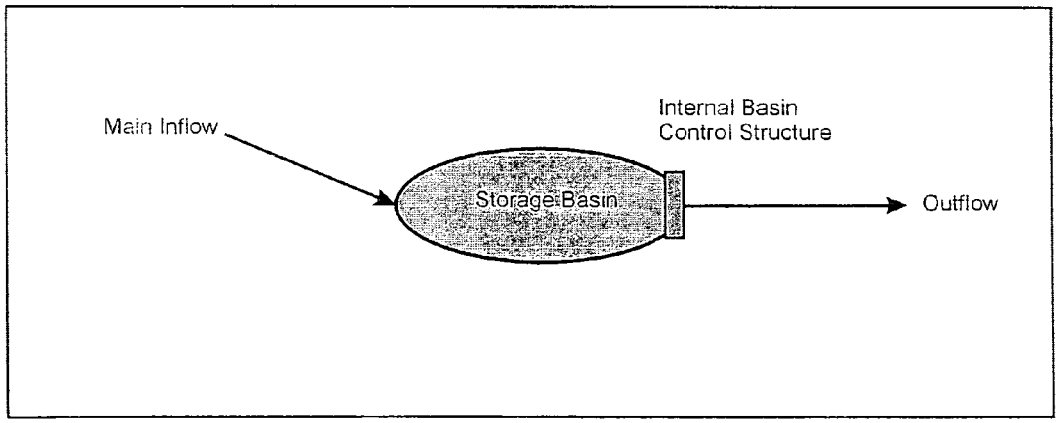

Figure 3: Ideal Outflow Hydrograph
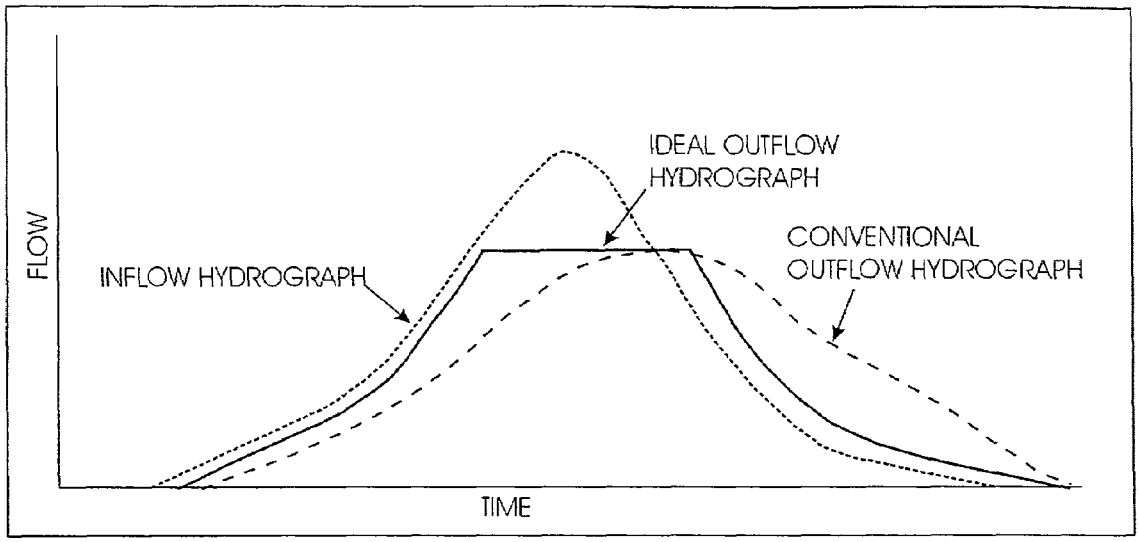
Figure 4: Simple Extention Basin System Flow Path
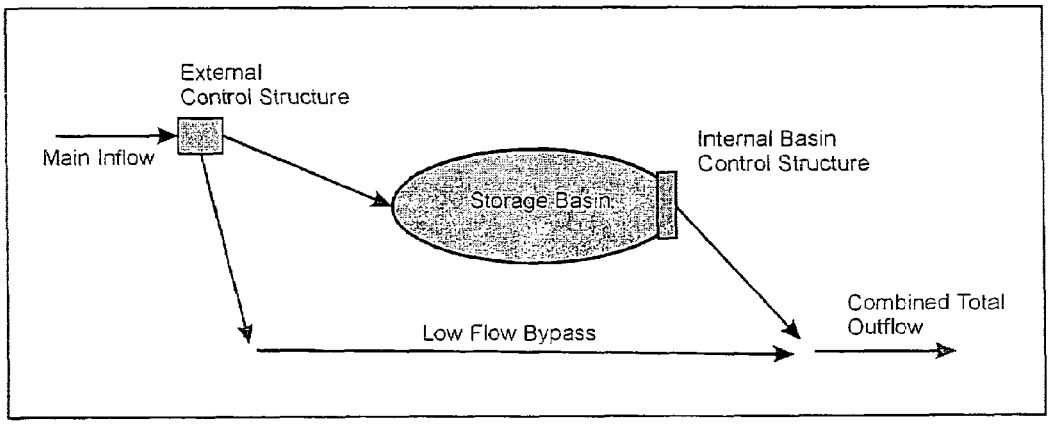

Figure 5A: Extention Basin System Flow Path with Storm Water Treatment
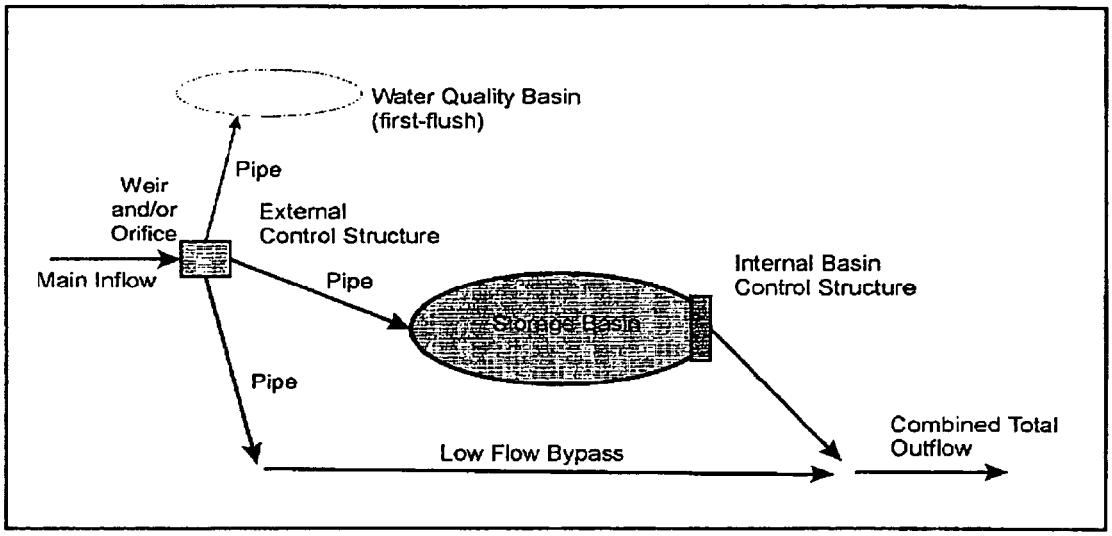
Figure 5B: Extention Basin System Flow Path with Storm Water Treatment
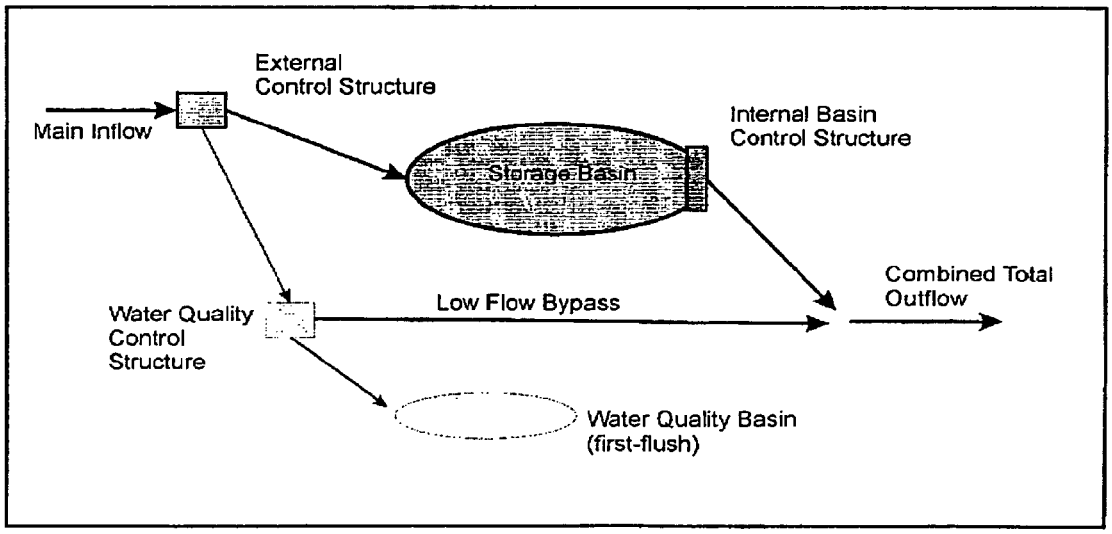

Figure 6: Case 2A – Inflow and Outflow Routing using a Conventional Detention Basin
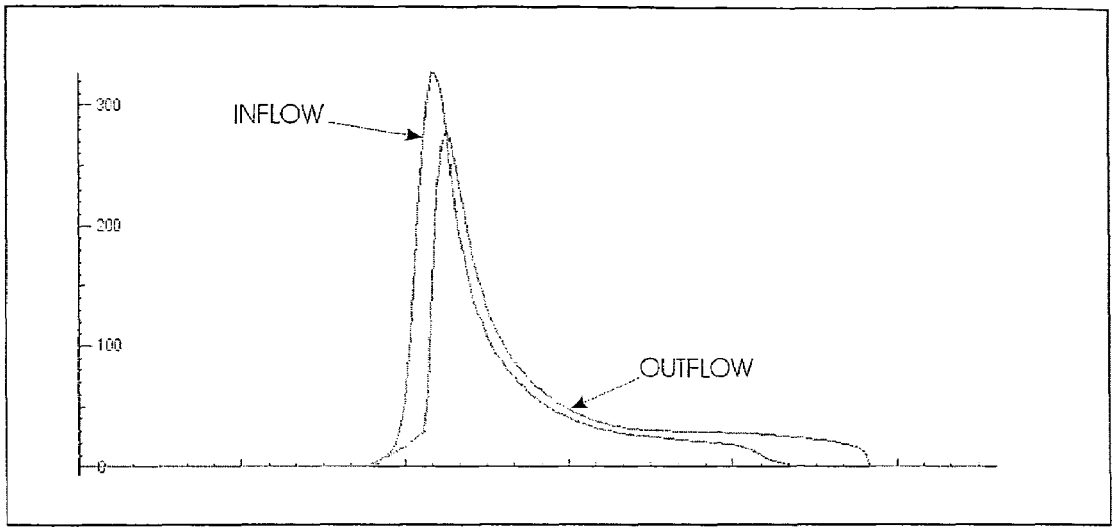
Figure 7: Case 2B – Inflow and Outflow Routing using a Conventional Detention Basin and Water Quality Storage
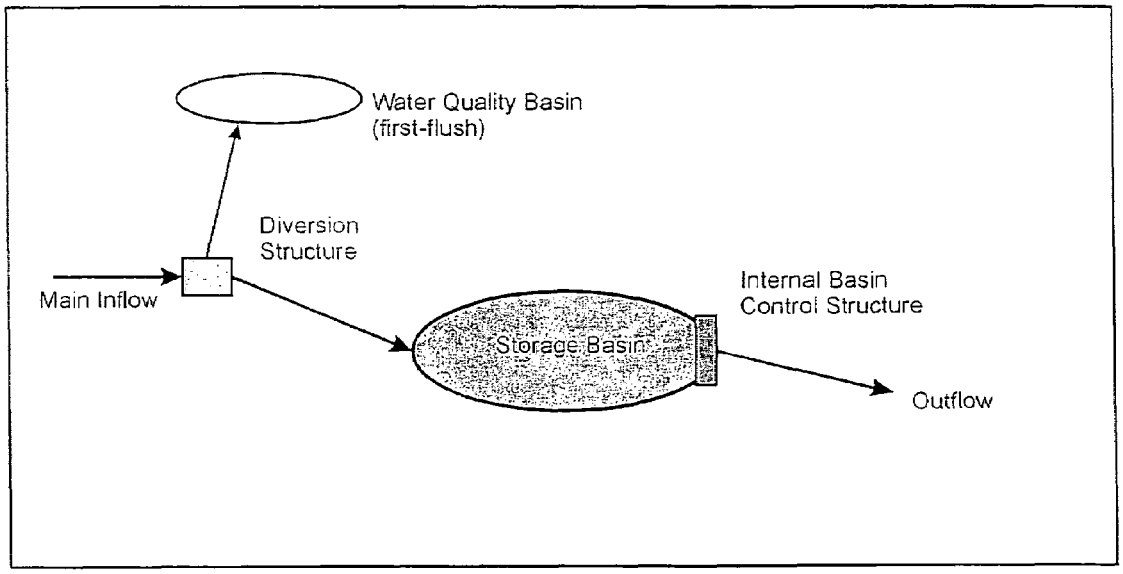

Figure 8: Inflow / Outflow of Conventional Detention with Water Quality Storage (4 in. rainfall)
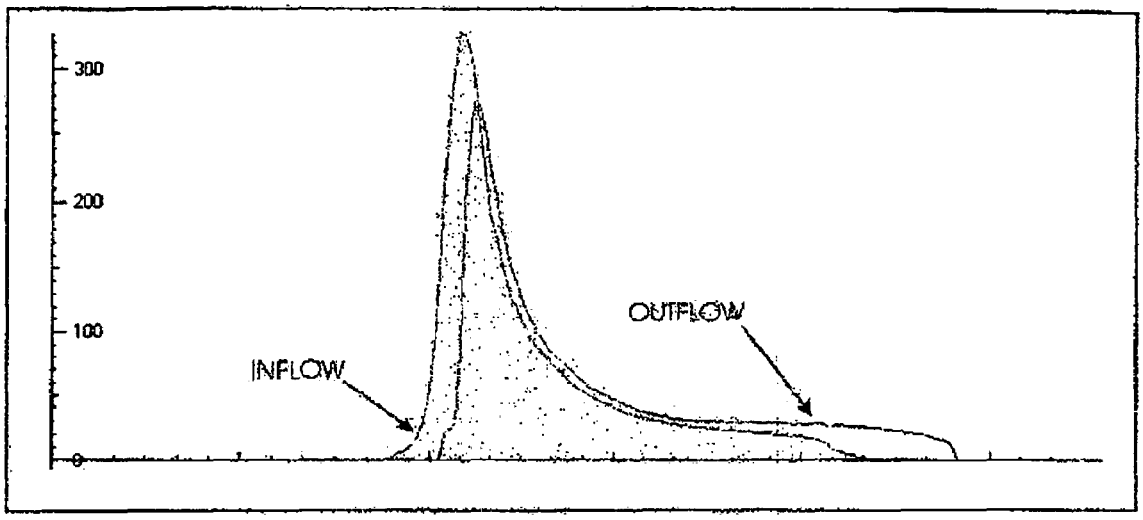

Figure 9: Case 3: Inflow and Outflow Routing of the Simple Extention Basin (4 in. of rainfall)
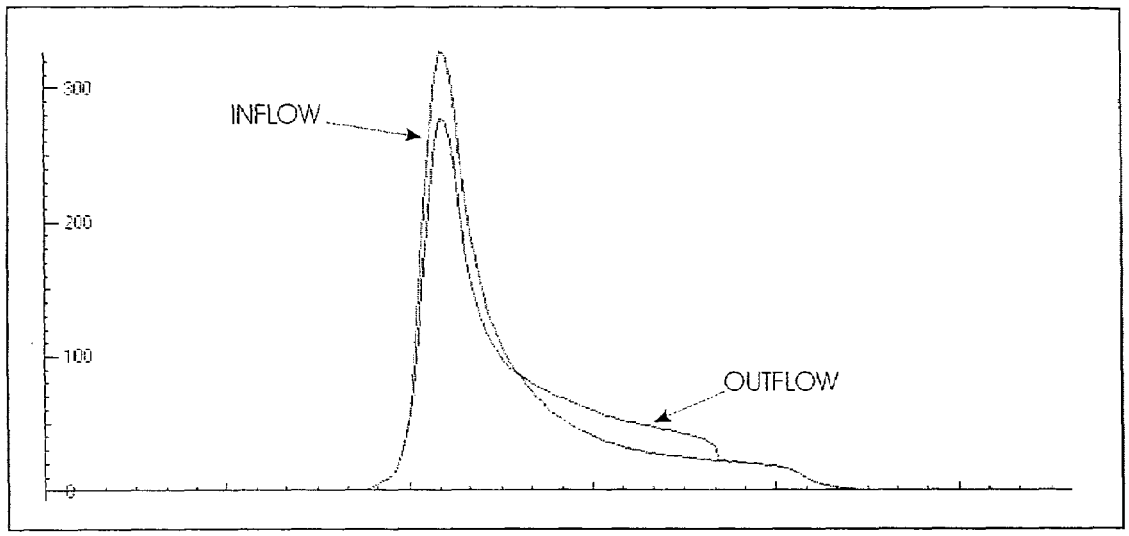
Figure 10: Case 4 - Existing Flow versus Extention Basin Outflow (4 in. of rainfall)
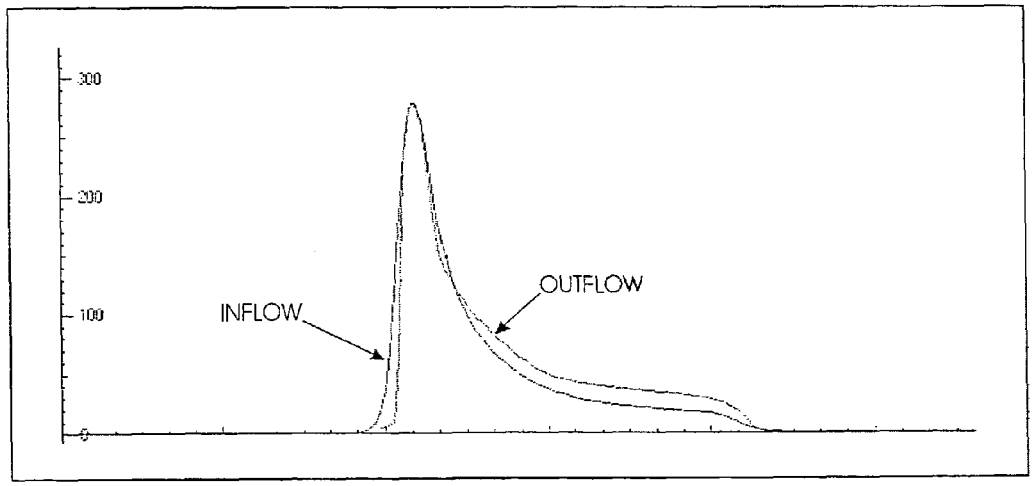

Figure 11: Close Comparison of Existing Flows / Proposed Flows and Extention Basin Outflows
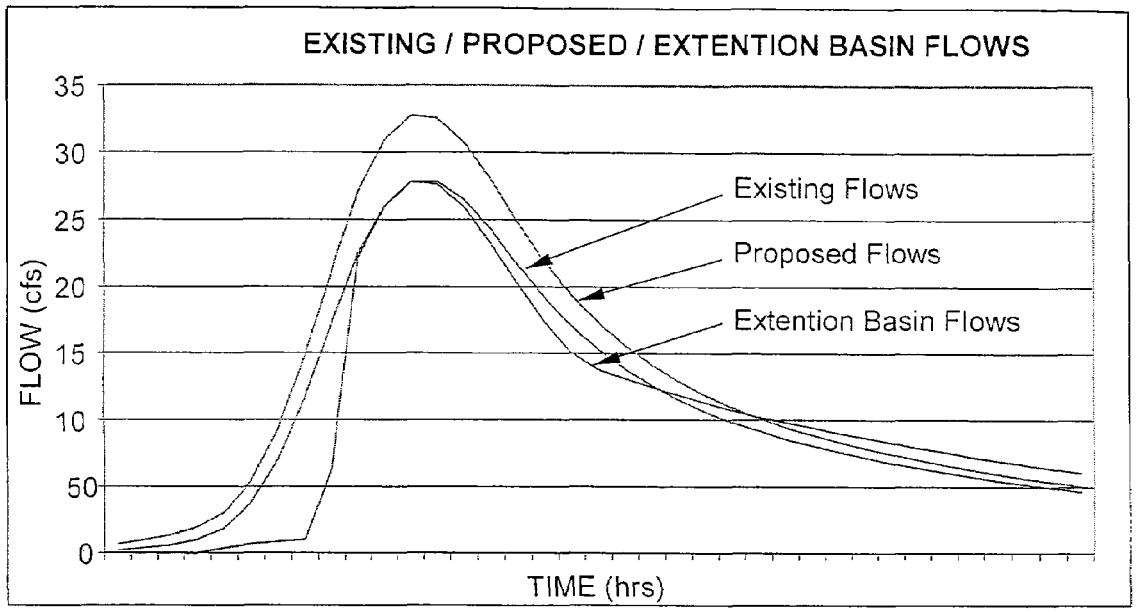

SYSTEM AND METHOD FOR USE OF AN EXTENTION BASIN AS A STORM WATER CONTROL DEVICE

The present application claims benefit of priority from U.S. Provisional Patent Application Ser. No. 60/466,929 filed Apr. 30, 2003.

BACKGROUND

Storm Water Management

The most effective, and possibly the only device for simply reducing or controlling storm water peak flow, is the storage basin—commonly known as a retention or detention basin. The term detention basin has come to be distinguished from a retention basin in that the latter is a storage device that has a normal pool of water such as a lake, pond or reservoir, while the detention basin is considered dedicated to its task and is normally empty. Both of these operate by the natural accumulation of storm water when a restriction, such as a weir or orifice, is placed on the flow.

These storage basins are typically used to mitigate storm water increases due to land development and are very effective when designed properly. For example, in a small watershed of 5 acres, for a shopping center that converts an existing wooded site to a land use consisting of pavement, the peak storm water flows can rise from 10 cfs to 20 cfs rather easily. In larger watersheds, proportional increases such as these could cause serious flooding and environmental damage.

The key criterion in storm water management is the limitation of after-development peak flows to rates equal to or less than the peak flows prior to development. In the example above, the developer of the shopping center would need to provide a storage basin to limit the after-development peak flows to 10 cfs. The developer may then need to provide substantial water quality treatment storage. Of course, the storage basin would occupy a significant portion of the site, typically ranging from five (5) to fifteen (15) percent or more of the development land area.

Many state and local municipalities normally require either control of storm water through written codes or insist on peak flow controls during the approval process. Whether or not storm water control is required, it is usually prudent to control storm water flows that are destined for off-site areas, merely to reduce the liability for damages in case of downstream flooding.

Storm Water Treatment

The treatment of storm water to improve water quality has gained considerable interest. Federal and state regulations now require storm water treatment for large sites and new Federal NPDES rules will require treatment from small sites. Further, some local municipal codes or environmental concerns mandate some form of storm water treatment for all sites.

A key criterion of storm water treatment is the capture of the first one-half (½) inch of runoff from newly disturbed areas within the watershed. The great majority of pollutants from runoff are contained in the first-flush. To treat the first-flush, the flows must be conveyed to specially designed water quality treatment basins where a variety of treatment processes take place, culminating with infiltration to the soil and/or evaporation. The water quality basins are designed particularly to capture only the first-flush of runoff, and to avoid the later segments of the runoff that would mix with and wash out the captured flow.

Our firm developed a simple design for a first-flush control device in 1990 that we have been using since on various engineering projects. Essentially, the control works on a hydraulic balancing principle—diverting the low flows to a water quality basin and then directing flows back to the drainage system when the water quality basin is full. The water quality basin is designed to store water for just a few days since an empty basin is necessary at the time of rainfall to fulfill the goal of water quality treatment.

Storm Water Storage Basin Theory

The method of computation used to design storm water storage systems is the straightforward and familiar application of conservation of mass principles—the volume flowing out is equal to the volume flowing into a system. This is known as the reservoir routing method, and a wide range of information is available on the subject in engineering and hydrology texts. A brief summation of the method is given here, as follows:

It is assumed for the numerical solution, that we are given the flow "Q" at every time interval "t", being the series, Qin(t).

Given: Vol(out)=Vol(in):

If a volume is allowed to accumulate (S), the modified mass equation accounts for this as follows:

$$\text{Vol(out)}=\text{Vol(in)}-S$$

| | | |
|---|---|---|
| In a time interval t: | $\text{Vol(out)}/\Delta t = \text{Vol(in)}/\Delta t - \Delta S/\Delta t$ | |
| Since: | $\text{Vol(out)}/\Delta t = \text{Qout(t)}$ | |
| And, since: | $\text{Vol(in)}/\Delta t = \text{Qin(t)}$ and $\Delta S = S(t)$ | |
| Substituting | $\text{Qout(t)} = \text{Qin(t)} - \Delta S/\Delta t$ | |
| Rearranging: | $S(t) = (\text{Qin(t)} - \text{Qout(t)}) \times \Delta t$ | (Eq. 1) |

As described in words, the change in volume of storage within any time interval is equal to the rate of inflow in minus the rate of outflow, multiplied by the interval of time.

The outflow of a storage basin can be modeled by a non-linear hydraulic function, "g" relating head, or height (stage) "H" in the basin, and various physical characteristics of the control device; e.g., length of a weir or diameter of a pipe, referred to as the set "n", and generally a constant "C".

| | | |
|---|---|---|
| For example: | $\text{Qout} = C \times g(n, H)$ | (Eq. 2) |

If the outflow of a storm water storage basin is restricted by a weir, the outflow function is as follows:

$$Q=C\times L\times H\hat{}3/2 \text{ or } Q\text{out}(t)=C\times L\times H(t)\hat{}3/2$$

| | | |
|---|---|---|
| Where: | C is a factor (3.337)<br>L is the weir length (ft) | H is the flood stage in the basin in feet and H(t) is the height at any time |

Further, there is a natural geometric relationship, or function "f" between height "H" and the volume "S" in the storage basin. This is often a tabular relationship between contour elevation and surface area that can readily be interpolated for storage volume at any height.

| For example: | $H = f(S)$ or $H(t) = f(S(t))$ | (Eq. 3) |
|---|---|---|

Equations 1, 2 and 3, above fully define the mathematics of the storage process that occurs in a detention or retention basin. The equations are easily solved by iterative techniques. The mathematical method is generally referred to by the generic term, reservoir routing, and it describes a relationship between inflow and outflow that can be seen graphically in FIG. 1.

It is important to note that the area between the inflow and outflow hydrograph is the exact equivalent of the storage volume reached in the storm water basin. Further, in the descending phase of the inflow, the area representing the outflow volume leaving the storage system is the 1 same as the inflow volume, unless some volume is captured within the system.

It is therefore an object of the invention to provide a system for reducing environmental impact of storm water flows, comprising a feed conduit, receiving storm water runoff; a bypass conduit; a detention basin; for reducing a net peak flow of storm water run off; a treatment basin, for removing pollutants from the storm water runoff; and a control system, receiving storm water runoff flow from the feed conduit, and splitting the flow between at least the detention basin, the treatment basin, and the bypass conduit, wherein a flow to the treatment basin is sensitive to a water level therein, a managed quantity of water flowing to the treatment basin until filled, and a remainder of the flow is split in a flow rate sensitive proportion to the bypass conduit and detention basin.

This system may operate in an environmental region, having a natural hydrograph, a development, situated within the environmental region, having a development hydrograph characterized by a higher and earlier peak flow than the natural hydrograph, wherein the system for reducing environmental impact of storm water flows delays the time of peak flow and reduces the level of peak flow of the development hydrograph, resulting in a mitigated hydrograph corresponding to the natural hydrograph.

It is also an object of the present invention to provide an environmental system, subject to storm water flows, comprising an environmental region, having a natural hydrograph, a development, situated within the environmental region, having a development hydrograph characterized by a higher and earlier peak flow than the natural hydrograph, a storm water runoff mitigation system, receiving storm water runoff from the development according to the development hydrograph, having a mitigated hydrograph, comprising:

(1) a bypass conduit, (2) a detention basin, for reducing a net peak flow of storm water runoff;

(3) a treatment basin, for removing pollutants from the storm water runoff; and (4) a control system, receiving storm water runoff flow, and splitting the flow between at least the detention basin, the treatment basin, and the bypass conduit, wherein a flow to the treatment basin is sensitive to a water level therein, a managed quantity of water flowing to the treatment basin until filled, and a remainder of the flow is split in a flow rate sensitive proportion to the bypass conduit and detention basin, wherein the mitigated hydrograph has a peak flow rate at or below the natural hydrograph.

It is a further object of the invention to provide a method for reducing environmental impact of storm water flows, comprising receiving storm water runoff flow, and splitting the flow between at least a detention basin, a treatment basin, and a bypass conduit wherein a flow to the treatment basin is sensitive to a water level therein, a managed quantity of water flowing to the treatment basin until filled, and a remainder of the flow is split in a flow rate sensitive proportion to the bypass conduit and detention basin, the detention basin reducing a net peak flow of storm water runoff and the treatment basin removing pollutants from the storm water runoff.

The system may further comprise an outlet conduit, receiving flow from the detention basin and the bypass conduit. The control system may, for example, operate passively. A flow splitting may therefore occur passively. A partition of flows between the bypass conduit and the detention basin may be based on one or more of a respective pipe diameter, and a respective pipe height within a chamber. A partition of flows between the bypass conduit and the detention basin may be based on characteristics selected from the group consisting of one or more of a pipe diameter, a pipe height, orifice structure, and a weir structure. Under peak flow conditions, a water efflux rate from the bypass conduit and detention basin is preferably reduced by this system. A first flush runoff may be selectively shunted to the treatment basin. A treatment basin capacity may be established at level sufficient to hold a first flush volume plus an amount sufficient to minimize the aggregate volume of the detention basin and treatment basin, constrained by a predetermined peak flow efflux rate from an optimized combination of detention basin and bypass conduit characteristics; wherein the characteristic of the treatment basin, detention basin, and control system may be optimized through an iterative process. The control system is preferably optimized to reduce peak flows from the detention basin and bypass conduit according to the Army Corps of Engineers HEC-1 computer program. Preferably, the mitigated hydrograph models the natural hydrograph.

BRIEF DESCRIPTION OF THE DRAWINGS

FIG. 1 shows a relationship between inflow and outflow of a typical reservoir.

FIG. 2 shows the flow path of the reservoir represented in FIG. 1.

FIG. 3 shows a theoretically efficient storage basin, in which outflow follows the inflow hydrograph.

FIG. 4 shows a flow schematic of simple extention basin operation.

FIG. 5A schematically shows a system in which a water quality feature is added to the flow path by simply permitting the first low flows, up to the volume of inflow equal to the first-flush.

FIG. 5B schematically shows an advanced layout which places an additional control structure on the low flow bypass of the system shown in FIG. 5A.

FIG. 6 shows hydrologic flows in such a detention basin.

FIGS. 7 and 8 shows respectively, the flow path, and flow rates, in a system which attempts to control peak flows and provide the required water quality storage volume, in which the water quality basin is fed by a diversion of the main watershed flow until the value of 5.33 acre-feet is reached, and thereafter, the remaining flow is detained in a conventional storage basin.

FIG. 9 shows the inflow and outflow routing of the simple extention basin when receiving 4 in. of rainfall.

FIG. 10 shows the results of the existing flows as compared to the final flows from an extention basin, when receiving 4 in. of rainfall.

FIG. 11 shows a comparison of a comparison of existing flows, proposed flows, and extension basin flows.

DESCRIPTION OF THE INVENTION

The hydrographs in FIG. 1 represent the flow in and out of a typical storage basin whose flow paths are represented by FIG. 2.

To absolutely minimize the amount of storage volume needed, one must allow the outflow hydrograph to closely track the rise in the inflow hydrograph until a pre-determined flow is reached. In theory, the most efficient storage basin—one with the least storage for the same flow reduction, is one whose outflow follows this non-continuous route, as shown in FIG. 3.

Such an outflow function is difficult to replicate using standard reservoir routing, though it can be provided by using mechanical intervention. For example, to restrict outflows to, say 100 cfs, an operator can be stationed at a valve in the system. The operator would know when to open the valve and divert flows away or towards the design point.

This mechanical system is not acceptable in practice for a variety of reasons, least of which is the reliance on mechanical means in perpetuity as well as the monitoring of rainfall and runoff rates. Clearly, a fully non-mechanical method of performing the same task is our goal.

The extention basin provides such an automatic function. It operates hydraulically and non-mechanically, by allowing the storm flow to bypass the storage basin during the ascending part of the storm then diverts flow into the storage basin only during the period of peak inflow. The extention basin provides flow reductions through external control structures and external piping, and extends the functionality of the storage basin by adding water quality treatment, hence the given name.

A flow schematic of a simple extention basin operation is shown in FIG. 4.

A simple extention basin will control peak flows over a narrow range of storm frequencies. The following is a narrative of the operation and components of the simple extention basin.

1. Inflows are directed to the external control structure that is comprised of a low-level pipe outlet and a high level, diverting weir. The low flows bypass the storage basin in the bypass piping and are conveyed to a junction point.
2. At a calculated high-level flow, the diverting weir develops enough head to discharge to the storage basin. Generally, the diverting weir is long to allow a rapid flooding into the storage basin.
3. At mid-level to high-level flows, the storage basin takes the bulk of the main flow with some limited bypass continuing in the low flow piping.
4. The outflow of the storage basin, as controlled by the internal control structure, a weir, pipe or combinations, joins with the low flow bypass to produce a combined total outflow at the design point.

Operation of the Extention Basin with Storm Water Treatment

A water quality feature is added to the flow path by simply permitting the first low flows, up to the volume of inflow equal to the first-flush, to enter the water quality basin, as shown in FIG. 5A. When the desired level in the water quality basin is reached, further flow is inhibited due to the backwater effect from the developed head in the water quality basin. Hence, the operation is similar to the simple extention basin noted above, except additional storage is added for water quality treatment.

An advanced layout places an additional control structure on the low flow bypass, as illustrated in FIG. 5B.

Sample Computations for the Extention Basin

A numerical proof of the improved operation of the extention basin can be provided based on the earlier equations or by a simple inspection of the nature of the inflow and ideal outflow hydrograph. A practical proof is easily provided by modeling the extention basin using a variety of sample cases and computing the results using readily available software.

While there are a number of software products that can be used to model the flows through the extention basin system, we have used the Army Corps of Engineers HEC-1 program here. The HEC-1 software allows a number of the necessary and detailed hydraulic techniques.

For example, the development of separate hydrographs is needed for the low flow bypass and the inflow to the storage basin. HEC-1 can create these hydrographs using the diversion card (HEC-1 was written in FORTRAN and uses card style input). Further, in the plan with storm water treatment, the diversion cards can also be used to track the filling of the water quality basin and the subsequent re-diversion to the low flow bypass.

Of course, HEC-1 provides hydrograph creation based on watershed characteristics of curve number, lag time and area, as well as hydrograph summation and basic graphing functions.

Since the design of the extention basin is most practical by trial and error or iteration, we have developed a new Windows™ interface to HEC-1 that greatly improves the program functionality and allows numerous trial runs to fine-tune the proposed hydraulic system design. It is necessary to adjust the diversion ratios; internal control structure dimensions and storage basin until the desired final design flows are met.

Description of the Sample Cases

To test our theory that the extention basin requires minimal storage while providing the required capture of the first-flush runoff, we have created a sample watershed system that undergoes development.

We assume the watershed is mildly developed in the present state with a composite SCS runoff curve number of 70.75.

We further assume that a large, new development site of about 0.20 square mile (125 acres) is contemplated, which would convert a portion of the wooded land use to essentially, all impervious areas, resulting in a new, composite curve number of 73.75.

The breakdown of existing and proposed land uses that comprise the SCS curve number is shown in Table A below:

TABLE A

Computation of Composite SCS Curve Number

| Land Use | Curve Number | Area | Product |
|---|---|---|---|
| | Existing Condition | | |
| Woods | 70 | 0.950 | 66.500 |
| Industrial | 85 | 0.050 | 4.250 |
| Total | 70.75 | 1.000 | 70.750 |

TABLE A-continued

| Computation of Composite SCS Curve Number | | | |
|---|---|---|---|
| Land Use | Curve Number | Area | Product |
| | Proposed Condition | | |
| Woods | 70 | 0.750 | 52.500 |
| Industrial | 85 | 0.050 | 4.250 |
| New Industrial | 85 | 0.200 | 17.000 |
| Total | 73.75 | 1.000 | 73.750 |

First-Flush of Runoff:

Since the base criterion for storm water treatment is the capture of the first-flush of runoff from the newly disturbed area, the volume of capture is computed to be 5.33 acre feet from 0.200 square miles, (0.5"/12×0.200×640 ac/sm).

The first-flush flow does not directly re-enter the drainage system—it is infiltrated to the soil, evaporated, or slowly drained back to the drainage system over a period of days at rates well below design storm frequencies.

First-flush capture for storm water treatment is generally additive to any storage required by the peak flow control system. In other words, if 9 acre-feet are required for storm water management, one must add the additional 5.33 acre-feet regardless of the method of storm water storage. In a conventional storage system it is impossible to use the storage required for water quality to offset the storage required for peak flow control without greatly over sizing the system, because the first-flush volume accumulates well before the time of peak runoff. In some limited applications, it is possible to offset the storage required for peak flow reduction in very small storms, when runoff is near to one-half (½) inch.

We seek a solution where the storage required for water quality can be credited fully in the process of storm water management and peak flow reductions.

Watershed Lag:

For simplicity, we have assumed that the watershed lag is 1.0 hour. This is certainly in the order of magnitude of the watershed size of 1 square mile. In general, the analysis herein can be done with any assumed value of lag. To simplify comparisons, we further assume that the lag time remains the same in both the existing and proposed case, and is possible when the new development is not on the flow path where lag time might be measured. If a new situation develops where the lag changes in the proposed condition, adjustment to the model can be made easily.

Rainfall:

For simplicity, we have chosen 4.0 inches of rainfall as the design storm. This is a mid-range value since design storms range from 3.2 inches up to 7.2 inches, depending on the application. The analysis herein can be run with any design storm. To be consistent, the same rainfall is assumed in both the existing and proposed condition.

The rainfall distribution is assumed as the SCS 24 hour, with Type 3 rainfall distribution and Type 2 antecedent moisture conditions. We have provided the synthetic rainfall ordinates in the computer input card file based on values commonly in use in our local area.

Control Structures:

The control structures are necessary to either divert or retard flow. In the storage basin, they are composed of a low-level pipe or orifice, a mid-level spillway weir and a high level weir to control overtopping. All elevations used are relative, and it assumed the designer would use proper techniques to design individual components.

Diversion control structures are devices that split flows according to certain, desired proportions. This is accomplished with weirs or notches that direct flows to different directions.

Peak Flow Reduction:

Each sample case assumes that the watershed flow must be reduced to 278 cfs for the design storm. This is the peak flow of the watershed at existing conditions. To compare methods, the storage volume necessary to produce this reduction is compiled for each case.

The following sample watershed characteristics are used to determine the inflow hydrographs.

TABLE B

| Sample Watershed Characteristics | | | |
|---|---|---|---|
| Item | Existing Condition | Proposed Condition | Units |
| Watershed Area | 1.0 | 1.0 | square miles |
| Watershed Lag Time | 1.0 | 1.0 | hours |
| SCS Runoff Curve Number | 70.75 | 73.75 | (no units) |
| Rainfall | 4.0 | 4.0 | inches |
| Rainfall Hydrograph | SCS Type 3–24 hr. | SCS Type 3–24 hr. | 0.1 hour inc. |
| Initial Abstraction | Computed Internally | Computed Internally | inches |
| Base Flow | 0 | 0 | cfs |

Sample Case 1A—Existing Conditions

This case assumes a watershed without development. It is provided to illustrate actual conditions in a typical situation, with nominal values that may be encountered by design engineers.

Based on the sample input data, the following are the results of the computations:

TABLE 1-A

| Results of Sample Case 1A - Existing Conditions | |
|---|---|
| Peak Flow | 278 c.f.s |
| Time of Peak Flow | 13.17 hours |

Sample Case 1B—Proposed Conditions without Control in Storage Basins

In this case, we model the peak flows after development, where flows are left uncontrolled. The change in development is modeled by simply increasing the SCS runoff curve number of the undeveloped case, based on the addition of 125 acres of impervious area in the watershed. The remaining watershed characteristics are assumed to be unchanged by the development.

TABLE 2-A

| Results of Sample Case 1B - Proposed Conditions | |
|---|---|
| Peak Flow | 328 cfs |
| Time of Peak Flow | 13.00 hours |

Sample Case 2A—Control of Flows using the Conventional Detention Basin without Water Quality Storage In this case, the after development flows are routed through a conventional detention basin system using reservoir routing techniques. The flows in such a conventional detention basin are shown in FIG. 6. The characteristics of the detention basin are as follows:

TABLE 2-C

Storage Volume versus Elevation/Surface Area - Conventional Detention Basin

| Elevation (feet) | Surface Area (acres) | Volume (acre-feet) |
|---|---|---|
| 340 | 0 | 0.000 |
| 342 | 0.87 | 0.553 |
| 344 | 2.17 | 3.448 |
| 346 | 2.45 | 8.065 |
| 348 | 2.74 | 13.253 |
| 350 | 3.04 | 19.030 |
| 352 | 3.36 | 25.427 |

TABLE 2-D

Results of Sample Case 2A Proposed Conditions/Conventional Detention Basin without Water Quality Storage

| | |
|---|---|
| Peak Inflow | 328 cfs |
| Peak Outflow | 278 cfs |
| Time of Peak Flow | 13.50 hours |
| Peak Height in Basin | 349.43 feet |
| Volume of Storage | 17 acre-feet |

Sample Case 2B—Control of Flows using the Conventional Detention Basin and Water Quality Storage In this case, we attempt to control peak flows and provide the required water quality storage volume. The water quality basin is fed by a diversion of the main watershed flow until the value of 5.33 acre-feet is reached, thereafter, the remaining flow is detained in a conventional storage basin.

The flow path, and flow rates, respectively, of this case is illustrated in FIGS. 7 and 8.

TABLE 2E

Results of Sample Case 2B Proposed Conditions - Conventional Peak Flow Storage and Water Quality Storage

| | |
|---|---|
| Peak Inflow | 328 cfs |
| Peak Outflow | 278 cfs |
| Time of Peak Flow | 13.50 |
| Peak Height in Basin | 348.85 |
| Volume of Storage | 16.0 acre-feet |
| Volume of WQ Storage | 5.33 acre-feet |

Sample Case 3—Control of Flows using the Simple Extention Basin

In this case, the after development flows are routed through the simple extention basin system with a portion of the flow diverted to a water quality basin. The diversions are set according to the following relationships:

TABLE 3-A

Diversion Schedules for Case 3

| | | | | | | | | |
|---|---|---|---|---|---|---|---|---|
| Inflow (cfs) | 0 | 10 | 20 | 50 | 80 | 100 | 180 | 300 |
| Divert to Design Point (cfs) | 0 | 10 | 20 | 40 | 55 | 65 | 120 | 230 |
| Remaining Flow to Storage Basin (cfs) | 0 | 0 | 0 | 10 | 25 | 35 | 60 | 70 |

The volume characteristics of the storage basin are as follows:

TABLE 3-B

Storage Volume versus Surface Area/Elevation - Simple Extention Basin

| Elevation (feet) | Surface Area (acres) | Volume (acre-feet) |
|---|---|---|
| 340 | 0 | 0.000 |
| 342 | 0.87 | 0.553 |
| 344 | 2.17 | 3.448 |
| 346 | 2.45 | 8.065 |
| 348 | 2.74 | 13.253 |
| 350 | 3.04 | 19.030 |
| 352 | 3.36 | 25.427 |

TABLE 3-B

Results of Sample Case 3 Proposed Conditions/Simple Extention Basin

| | |
|---|---|
| Peak Inflow | 328 cfs |
| Peak Flow | 278 cfs |
| Time of Peak Flow | 13.00 |
| Peak Height in Basin | 346.19 |
| Volume of Storage | 9.0 acre-feet |
| Volume of Water Quality Storage | 5.33 acre-feet |

The inflow and outflow routing of the simple extention basin (4 in. of rainfall) in this case is shown in FIG. 9.

Discussion: Simple Extention Basin

In sample case 2A, we used a conventional detention basin computation that brought the peak flow from 328 cfs to 278 cfs and required 17 acre-feet of storage. In contrast, sample cases 3 and 4 provide clear proof that the simple extention basin can provide the same reduction in peak flows with about one-half the storage (9.0 acre-feet).

In a variation of Sample Case 2. Sample Case 2B adds 5.33 acre-feet of water quality storage to the required peak flow storage requirement of 16 acre-feet, totaling 21.33 acre-feet. This variation in Case 2 was provided here, to assess if simply adding first-flush storage alone is effective in reducing peak flows. The results indicate it was only slightly effective, reducing the net required storage by about 5 percent (22.33 to 21.33 ac-ft). For comparison purposes, the simple extention basin in Case 3 required only 9 acre-feet of storage plus the required 5.33 acre-feet, for 14.33 acre-feet, total.

This remarkable result is evident graphically (FIG. 9)—the outflow hydrograph follows the rising limb of the inflow hydrograph and the need for storage is minimized accordingly.

However, the practical need of storm water management is to control flows over a range of storms, say, from the 2 year to the 100-year storm event. The simple extention basin would not be able to control flows much lower than its design because its inherent bypass system allows low flows out to the design point without control. It is, however, the most effective system to control a small, well-defined range of storm frequencies.

Given the need to capture the first flush, and remembering that the first-flush capture basin is really only effective in reducing peak flows when the main flows are small, we can integrate the storm water control and water quality control in our highly effective, extention basin. This is illustrated in Sample Case 4, below:

Sample Case 4—Control of Flows using the Extention Basin and Storm Water Treatment In our final Sample Case 4, a water quality basin is added to the extention basin system and we attempt to control a wide range of storm frequencies. Flows are diverted to the water quality basin until the pre-computed first-flush volume of ½ inch of runoff over the newly developed portion of the watershed is reached.

A portion of the flow is conveyed to the water quality basin by imposing a new diversion control structure on the low flow bypass of the simple extention basin. The lowest flows are directed to the water quality basin, thereafter, when the basin is full, flows are naturally re-directed to the final design point by the principle of hydraulic balancing.

Our sample case requires that 5.33 acre-feet of first-flush runoff be stored in the water quality basin. This value is placed in field 2 of the DT input card file of our HEC-1 model.

Most importantly, this case examines a range of flows from 1.84 inches of rainfall, to 4.0 inches of rainfall. This is accomplished in HEC-1 by creating 6 plans as evidenced by the JR multiratio card. The ratios of each plan range from 0.46 to 1.00 and operate in HEC-1 by re-computing the entire model for each ratio times the design rainfall of 4.0 inches on the PB card.

For Case 4, we have assumed that the 100-year storm is 4.0 inches of rainfall in 24 hours, and have provided rainfalls for the 2, 5, 10, 25 and 50-year storms by the multiratio plans. In fact, 100-year storms are closer to 7 inches of rainfall in the northeast; however, we use the lower value to maintain consistency with our goal of using mid-range flows whenever possible in the sample cases. Any reasonable value of rainfall can be used to compare the effectiveness of the extention basin to the detention basin since the computations are always relative.

The following are the steps in the final computation over a range of flows:

TABLE 4-A

Storage Volume versus Elevation - Extention Basin

| Elevation (feet) | Surface Area (acres) | Volume (acre-feet) |
|---|---|---|
| 340 | 0 | 0.000 |
| 342 | 0.87 | 0.553 |
| 344 | 2.17 | 3.448 |
| 346 | 2.45 | 8.065 |
| 348 | 2.74 | 13.253 |
| 350 | 3.04 | 19.030 |
| 352 | 3.36 | 25.427 |

TABLE 4-B

Storage Volume versus Elevation - Water Quality Basin

| Elevation (feet) | Surface Area (acres) | Volume (acre-feet) |
|---|---|---|
| 340 | 0.00 | 0.00 |
| 342 | 0.20 | 0.13 |
| 344 | 0.53 | 0.83 |
| 346 | 1.06 | 2.39 |
| 348 | 1.93 | 5.33 |

TABLE 4-C

Diversion Schedules for Case 4

| | | | | | | | | |
|---|---|---|---|---|---|---|---|---|
| Inflow (cfs) | 0 | 10 | 20 | 50 | 80 | 100 | 180 | 300 |
| Divert to Design Point (cfs) | 0 | 10 | 20 | 40 | 55 | 65 | 120 | 237 |
| Remaining Flow to Storage Basin (cfs) | 0 | 0 | 0 | 10 | 25 | 35 | 60 | 63 |

TABLE 4-D

Computation of First Flush Volume Required:

| | | |
|---|---|---|
| New Impervious -- Disturbed Area | 125 | acres |
| Rainfall to be Captured | 0.5 | inches |
| Computed Volume to be Captured | 5.33 | acre-feet |

TABLE 4-E

Sample Case 4 - Summary of Peak Flows by Storm Frequency

| Storm Frequency (year) | Existing Flow (cfs) | Proposed Inflow (cfs) | Extention Basin Outflow (cfs) |
|---|---|---|---|
| 100 | 278 | 328 | 278 |
| 50 | 209 | 251 | 203 |
| 25 | 161 | 198 | 151 |
| 10 | 111 | 144 | 107 |
| 5 | 72 | 99 | 72 |
| 2 | 27 | 42 | 24 |

Discussion of the Extention Basin:

It is clear from the summary Table 4-E, that the extention basin system has reduced peak flows to almost match the original flows, and more importantly, it has done this over a wide range of flows.

For example, the 100-year storm runoff is 278 cfs both in the existing and proposed cases, even though the development in the watershed has increased to flows 328 cfs. The 2-year storm has been reduced from the proposed flow of 42 to 24 cfs—slightly below the existing peak flow of 27 cfs.

The graph of the results of the existing flows as compared to the final flows is shown in FIG. 10.

A close-up comparison of the final results along with the proposed, after-development inflows for the 100-year storm is shown on the graph in FIG. 11.

In FIG. 11, the existing hydrograph is nearly identical to the extention basin outflows when comparing both peak time and hydrograph shape. It is immediately apparent from the graphs that the extention basin accomplishes an additional task of limiting the lag in the peak outflow.

The reduction of outflow lag is an added, environmental benefit of the extention basin since any natural drainage system is less likely to be affected by the change in timing. Further, we have eliminated unknown flooding affects associated with timing of peak flows from other watersheds.

Sample Case Summary:

Each sample case performed the task of reducing the after development peak flow from 328 cfs to the design peak flow of 278 cfs using a storage basin. The conventional storage basin system using standard reservoir routing techniques computed the storage at 17 acre-feet (16 acre-feet for case 2B), to these values we must add 5.33 acre feet required for first-flush storage.

The extention basin performed very much better, requiring only 9 acre feet of storage to control peak flows and 5.33 acre feet for storm water treatment for a total storage of 14.33 acre-feet.

The Table below summarizes the storage required for each sample case.

TABLE 5

Comparison of Storage Requirements for the Sample Cases

| Sample Case | Description | Storage Volume for Peak Flow Control | Storage Volume for Water Quality Treatment (acre-feet) | Total Storage Volume Required |
|---|---|---|---|---|
| 1-A | Existing Conditions | n.a. | n.a. | n.a. |
| 1-B | After Development Conditions | n.a. | n.a. | n.a. |
| 2-A | Conventional Detention Basin - No Water Quality Treatment | 17 | n.a. | n a |
| 2-B | Conventional Detention Basin w/ Water Quality Treatment | 16 | 5.33 | 21.33 |
| 3 and 4 | Extention Basin w/ Water Quality Treatment | 9.0 | 5.33 | 14.33 |

TABLE 6

Summary of Peak Flows and Peak Time versus Storm Frequency for each Sample Case

| Sample Case | Storm Frequency (years) 100 | 50 | 25 | 10 | 5 | 2 |
|---|---|---|---|---|---|---|
| | **Peak Flows** (cfs)/**Peak Time** (hrs) (increased flows are red light shaded) | | | | | |
| 1-A | **278/13.17** | **209/13.17** | **161/13.17** | **111/13.17** | **72/13.17** | **27/13.33** |
| 1-B | 328/13.00 | 251/13.00 | 198/13.17 | 144/13.17 | 99/13.17 | 42/13.33 |
| 2-A | 278/13.00 | 208/13.17 | 158/13.17 | 114/13.17 | 81/13.17 | 42/13.33 |
| 2-B | 278/13.50 | 197/13.67 | 139/13.83 | 80/14.33 | 36/15.50 | 22/15.50 |
| 3 | 278/13.00 | 208/13.17 | 158/13.17 | 114/13.17 | 81/13.17 | 42/13.33 |
| 4 | **278/13.00** | **203/13.17** | **151/13.17** | **107/13.17** | **72/13.50** | **24/14.83** |

CONCLUSION

The extention basin provides the control of peak flows using less storage than a conventional retention or detention basin. This phenomenon occurs because we have found a method to "tune" the system to minimize the storage requirement.

The extention basin described in our sample case requires only about 67% of the storage of a conventional storage basin where water quality treatment is also required (Case 3 vs. Case 2-B), and controls flows over a very wide range of storm frequencies.

Similarly, when control is required over only a small range of storm frequencies and water quality treatment is not needed, the simple extention basin requires only about 50% of the storage of a conventional storage basin (Case 2A—100, 50, 25 year storm).

When the capture of the first-flush of storm water is required for water quality treatment and control of peak flows is required over a wide range of storm frequencies, the storage volume can be minimized by the use of an extention basin that uses storage volumes close to the theoretical minimum storage volume (Case 4).

Based on the theory involved, much greater savings in storage volume can be achieved than we have reported here. The actual savings would be dependent on the shape of the inflow hydrograph and the designer's ability to shape the outflow hydrograph using strategic diversions.

The technique for computing these detailed volumes is straightforward—and can be computed by trial and error methods. Since the expected savings of up to 50% in storage is so great, the additional design time required to fine-tune the computations using successive iteration is well worth the effort.

REFERENCES

1. U.S. Army Corps of Engineers HEC-1 Flood Hydrograph Package, Users Manual, September 1981, The Hydrologic Engineering Center, 609 Second Street, Davis, Calif. 95616
2. U.S. Army Corps of Engineers HEC-1 Computer Program
3. Urban Hydrology for Small Watersheds, USDA, Soil Conservation Service, Technical Release 55 Jun. 1986
4. RGM HEC 2000 Computer Program

What is claimed is:

1. A method for reducing environmental impact of storm water flows, comprising:

(a) providing a feed conduit for receiving storm water runoff and at least one outflow for discharging water;

(b) providing a control structure which apportions water flow from the feed conduit between a bypass conduit, detention basin and treatment basin;

(c) reducing a net peak flow of storm water runoff by use of the detention basin;

(d) removing pollutants from the storm water runoff in the treatment basin; and (e) receiving storm water runoff flow from the feed conduit, and splitting the flow with the control structure between at least the detention basin, the treatment basin, and the bypass conduit, wherein a flow to the treatment basin is sensitive to a water level therein, a managed quantity of water flowing to the treatment basin until filled, and a remainder of the flow is split in a flow rate sensitive proportion to the bypass conduit and detention basin; and (f) discharging water, in at least one stream comprising an output from the detention basin and the bypass conduit, wherein the discharged water is, with respect to the feed conduit, at a reduced peak flow rate, and is treated to improve quality.

2. The method according to claim 1, further comprising receiving flow from the detention basin and the bypass conduit through an outlet conduit.

3. The method according to claim 1, wherein said receiving step employs a control system which operates passively.

4. The method according to claim 1, wherein a partition of flows between the bypass conduit and the detention basin is based on a respective pipe diameter.

5. The method according to claim 1, wherein a partition of flows between the bypass conduit and the detention basin is based on a respective pipe height within a chamber.

6. The method according to claim 1, wherein a partition of flows between the bypass conduit and the detention basin is based on a weir structure.

7. The method according to claim 1, wherein a partition of flows between the bypass conduit and the detention basin is based on a characteristics selected from the group consisting of one or more of a pipe diameter, a pipe height, orifice structure, and a weir structure.

8. The method according to claim 1, wherein, under peak flow conditions, a water efflux rate from the bypass conduit and detention basin is reduced.

9. The method according to claim 1, wherein a first flush runoff is selectively shunted to the treatment basin.

10. The method according to claim 1, wherein a treatment basin capacity is established at a level sufficient to hold a first flush volume plus an amount sufficient to minimize the aggregate volume of the detention basin and treatment basin, constrained by a predetermined peak flow efflux rate from an optimized combination of detention basin and bypass conduit characteristics.

11. The method according to claim 10, wherein the characteristics of the treatment basin, detention basin, and control system are optimized through an iterative process.

12. The method according to claim 1, wherein peak flow reduction from the detention basin and bypass conduit is optimized according to the Army Corps of Engineers HEC-1 computer program (June 1998).

13. The method according to claim 1, further comprising defining an environmental region, having a natural hydrograph, a development, situated within the environmental region, having a development hydrograph characterized by a higher and earlier peak flow than the natural hydrograph, wherein said method for reducing environmental impact of storm water flows delays the time of peak flow and reduces the level of peak flow of the development hydrograph, resulting in a mitigated hydrograph corresponding to the natural hydrograph.

14. A method, comprising:

(a) defining an environmental region, having a natural hydrograph;

(b) defining a development, situated within the environmental region, having a development hydrograph characterized by a higher and earlier peak flow than the natural hydrograph;

(c) providing a storm water runoff mitigation system, receiving storm water runoff from the development according to the development hydrograph, having a mitigated hydrograph, comprising:

(1) a bypass conduit;

(2) a flow through detention basin, for reducing a net peak flow of storm water runoff; and (3) a treatment basin, for removing pollutants from the storm water runoff; and (d) receiving storm water runoff flow, and splitting the flow between at least the detention basin, the treatment basin, and the bypass conduit, wherein a flow to the treatment basin is sensitive to a water level therein, a managed quantity of water flowing to the treatment basin until filled, and a remainder of the flow is split in a flow rate sensitive proportion to the bypass conduit and detention basin; and discharging water, in at least one stream comprising an output from the detention basin and the bypass conduit, wherein the mitigated hydrograph has a peak flow rate at or below the natural hydrograph.

15. The method according to claim 14, further comprising receiving flow from the detention basin and the bypass conduit through an outlet conduit.

16. The method according to claim 14, wherein said receiving step employs a control system which operates passively.

17. The method according to claim 14, wherein a partition of flows between the bypass conduit and the detention basin is based on a respective pipe diameter.

18. The method according to claim 14, wherein a partition of flows between the bypass conduit and the detention basin is based on a respective pipe height within a chamber.

19. The method according to claim 14, wherein a partition of flows between the bypass conduit and the detention basin is based on a weir structure.

20. The method according to claim 14, wherein a partition of flows between the bypass conduit and the detention basin is based on a characteristics selected from the group consisting of one or more of a pipe diameter, a pipe height, orifice structure, and a weir structure.

21. The method according to claim 14, wherein, under peak flow conditions, a water efflux rate from the bypass conduit and detention basin is reduced.

22. The method according to claim 14, wherein a first flush runoff is selectively shunted to the treatment basin.

23. The method according to claim 14, wherein a treatment basin capacity is established at a level sufficient to hold a first flush volume plus an amount sufficient to minimize the aggregate volume of the detention basin and treatment basin, constrained by a predetermined peak flow efflux rate from an optimized combination of detention basin and bypass conduit characteristics.

24. The method according to claim 23, wherein the characteristics of the treatment basin, detention basin, and control system are optimized through an iterative process.

25. The method according to claim 14, wherein peak flow reduction from the detention basin and bypass conduit is optimized according to the Army Corps of Engineers HEC-1 computer program (June 1998).

26. The method according to claim 14, wherein the mitigated hydrograph models the natural hydrograph.

27. A method for reducing environmental impact of storm water flows, comprising receiving storm water runoff flow, splitting the flow between at least a detention basin, a treatment basin, and a bypass conduit, wherein a flow to the treatment basin is sensitive to a water level therein, a managed quantity of water flowing to the treatment basin until filled, and a remainder of the flow is split in a flow rate sensitive proportion to the bypass conduit and detention basin, the detention basin reducing a net peak flow of storm water runoff and the treatment basin removing pollutants from the storm water runoff, and discharging water, in at least one stream comprising an output from the detention basin and the bypass conduit.

28. The method according to claim 27, further comprising directing flows from the detention basin and the bypass conduit to an outlet conduit.

29. The method according to claim 27, wherein said flow splitting occurs passively.

30. The method according to claim 27, further comprising the step of partitioning flows between the bypass conduit and the detention basin is based on a respective pipe diameter.

31. The method according to claim 27, wherein a partition of flows between the bypass conduit and the detention basin is based on a respective pipe height within a chamber.

32. The method according to claim 27, wherein a partition of flows between the bypass conduit and the detention basin is based on a weir structure.

33. The method according to claim 27, wherein a partition of flows between the bypass conduit and the detention basin is based on a characteristics selected from the group consisting of one or more of a pipe diameter, a pipe height, orifice structure, and a weir structure.

34. The method according to claim 27, wherein, under peak flow conditions, a water efflux rate from the bypass conduit and detention basin is reduced.

35. The method according to claim 27, wherein a first flush runoff is selectively shunted to the treatment basin.

36. The method according to claim 27, wherein a treatment basin capacity is established at a level sufficient to hold a first flush volume plus an amount sufficient to minimize the aggregate volume of the detention basin and treatment basin, constrained by a predetermined peak flow efflux rate from an optimized combination of detention basin and bypass conduit characteristics.

37. The method according to claim 27, wherein the characteristics of the treatment basin, detention basin, and control system are optimized through an iterative process.

38. The method according to claim 27, wherein splitting is optimized to reduce peak flows from the detention basin and bypass conduit according to the Army Corps of Engineers HEC-1 computer program (June 1998).

* * * * *